United States Patent [19]

Turrin

[11] 4,231,042

[45] Oct. 28, 1980

[54] HYBRID MODE WAVEGUIDE AND FEEDHORN ANTENNAS

[75] Inventor: Richard H. Turrin, Colts Neck, N.J.

[73] Assignee: Bell Telephone Laboratories, Incorporated, Murray Hill, N.J.

[21] Appl. No.: 68,621

[22] Filed: Aug. 22, 1979

[51] Int. Cl.[3] ..... H01Q 13/02

[52] U.S. Cl. ..... 343/786; 333/21 R

[58] Field of Search ..... 343/783, 786; 333/239, 333/241, 242, 21 R

[56] References Cited

U.S. PATENT DOCUMENTS

| | | | |
|---|---|---|---|
| 2,950,454 | 8/1960 | Unger | 333/242 |
| 3,121,206 | 2/1964 | Mandel | 333/242 |
| 3,289,121 | 11/1966 | Comte | 333/242 |
| 3,601,720 | 8/1971 | Nakahara | 333/242 |
| 3,732,571 | 5/1973 | Neale | 343/786 |
| 3,754,273 | 8/1973 | Takeichi et al. | 343/786 |
| 3,771,076 | 11/1973 | Kidner et al. | 333/242 |
| 3,772,619 | 11/1973 | Clarricoats | 333/21 R |
| 3,924,237 | 12/1975 | Fletcher et al. | 343/786 |
| 3,949,406 | 4/1976 | Yvard | 343/786 |
| 3,964,070 | 6/1976 | Drabowitch | 343/786 |
| 4,021,814 | 5/1977 | Kerr et al. | 343/786 |
| 4,071,834 | 1/1978 | Comte | 333/242 |
| 4,106,026 | 8/1978 | Bui-Hai et al. | 343/786 |

OTHER PUBLICATIONS

Takeichi et al., The Ring-Loaded Corrugated Waveguide, IEEE Trans. on MTT, vol. 19, No. 12, Dec. 1971, pp. 947–950.

Dragone, BSTJ, vol. 56, No. 6, Jul.-Aug. 1977, Reflection Transmission and Mode Conversion in a Corrugated Feed, pp. 835–867.

Dragone, Characteristics of a Broadband Microwave Corrugated Feed, BSTJ, vol. 56, No. 6, Jul.-Aug. 1977, pp. 869–888.

Boyd, Waveguide Design and Fabrication, BSTJ, vol. 56, No. 10, Dec. 1977, pp. 1892–1897.

*Primary Examiner*—Eli Lieberman

*Attorney, Agent, or Firm*—Erwin W. Pfeifle

[57] ABSTRACT

The present invention relates to a hybrid mode waveguide or feedhorn antenna for transforming the $TE_{11}$ mode into the $HE_{11}$ mode. The waveguide or feedhorn comprises a circular waveguide including a tubular section at the $TE_{11}$ mode entrance port changing in the antenna configuration to a conical section that flares outward to the feedhorn mouth, and a spiro-helical projection bonded to the interior surface of the waveguide. In a first arrangement, the spiro-helical projection comprises an initially flattened dielectrically coated wire that gradually returns to a rounded configuration in closely spaced helical turns after which the spacings between turns gradually increase linearly in the tubular section and then continue with uniform spacings in the conical section. In a second arrangement, multiple layers of closely-wound helically wound dielectrically coated wires, which layers gradually taper down to a single layer, can replace the closely spaced flattened-to-round wire section of the first arrangement.

12 Claims, 5 Drawing Figures

HYBRID MODE WAVEGUIDE AND FEEDHORN ANTENNAS

BACKGROUND OF THE INVENTION

1. Field of the Invention

The present invention relates to hybrid mode waveguide and feedhorn antenna and a mode conversion portion of a waveguide and, more particularly, to hybrid mode waveguide and feedhorn antenna and mode converting waveguide comprising a circular waveguide body which for the feedhorn antenna can include a conical section which flares outwards towards the mouth of the feedhorn antenna, and a spiro-helical projection bonded to a dielectric coating on the inner surface of the waveguide or feedhorn antenna. One arrangement for the spiro-helical projection comprises a helically wound dielectrically coated wire which is initially flattened and formed in closely spaced edge-wound turns and gradually changes to a rounded configuration before continuing with linearly increased spacing between the turns to effect mode conversion from the $TE_{11}$ mode to the $HE_{11}$ mode which changes to a uniform pitch as the helix progresses towards the mouth of the waveguide or feedhorn antenna. A second arrangement comprises multiple layers of dielectrically coated wire in closely spaced turns which gradually reduce to one layer before the spacing between turns is gradually increased in a linear manner to effect the mode conversion and then to a uniform pitch as the projection progresses to the mouth of the waveguide or feedhorn antenna.

2. Description of the Prior Art

Hybrid mode corrugated horn antennas have been in use in the microwave field for a number of years. Various techniques for forming the corrugated horn antennas have been used to provide certain advantages. For example, U.S. Pat. No. 3,732,571 issued to N. W. T. Neale on May 8, 1973 discloses a microwave horn aerial which is corrugated on its inner surface, defining a tapered waveguide mouth area, with at least one spiro-helical projection which can be produced by a screw cutting operation with a single start spiro-helical groove or by molding on a mandrel which can be withdrawn by unscrewing it.

In U.S. Pat. No. 3,754,273 issued to Y. Takeichi et al on Aug. 21, 1973, a circular waveguide feedhorn is disclosed which includes corrugated slots on the inner wall surface, the width of the slots abruptly changing from a smaller value in the portion near the axis of the waveguide to a larger value in the remaining portion of the slot.

In U.S. Pat. No. 4,106,026 issued to N. Bui-Hai et al on Aug. 8, 1978, a corrugated horn of the exponential type is disclosed with corrugations whose depth decreases exponentially from the throat of the horn towards its mouth.

In the typical prior art arrangements, construction is generally complicated and expensive with the possible exception of the Neale feedhorn described hereinbefore, and coupling to a dominate mode waveguide is difficult and limited in bandwidth.

The problem remaining in the prior art is to provide a hybrid-mode feedhorn antenna or waveguide of a design which is inexpensive to fabricate, provides simplified mode coupling of the $TE_{11}$ mode to the $HE_{11}$ mode, and is operative over a very wide frequency bandwidth.

SUMMARY OF THE INVENTION

The present invention solves the hereinbefore mentioned problem in the prior art and relates to hybrid mode waveguide or feedhorn antennas or mode converting waveguide sections and, more particularly, to hybrid mode waveguide or feedhorn antenna or mode converting waveguide section comprising a circular waveguide section which for the feedhorn antenna changes to a conical transition section that flares outwards towards the mouth of the feedhorn antenna, and a spiro-helical projection bonded to a dielectric coating on the inner surface of the waveguide or feedhorn antenna, the spiro-helical projection being formed from at least one helically wound dielectrically coated wire which has closely spaced turns for a portion of its length and then has the spacings between turns gradually increased as the helix progresses in the circular waveguide section to convert the $TE_{11}$ mode to the $HE_{11}$ mode and then proceeds towards the mouth of the waveguide or feedhorn antenna with a uniform pitch.

It is an aspect of the present invention that the spiro-helical projection of the present invention can be formed from a single dielectrically coated wire that is initially flattened and formed in closely spaced edge-wound turns for a portion of its length and then gradually changes to a rounded configuration before continuing with increased spacing between the turns in the mode converting waveguide section and then in a uniform pitch as the helix progresses towards the mouth of the waveguide or feedhorn antenna.

It is another aspect of the present invention that the spiro-helical projection be formed from multiple layers of helically wound dielectrically coated wires in closely spaced turns which gradually reduce to one layer before the spacings between the turns is gradually increased in a linear manner in the waveguide section and then proceed with a uniform pitch as the projection progresses to the mouth of the waveguide or feedhorn antenna.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
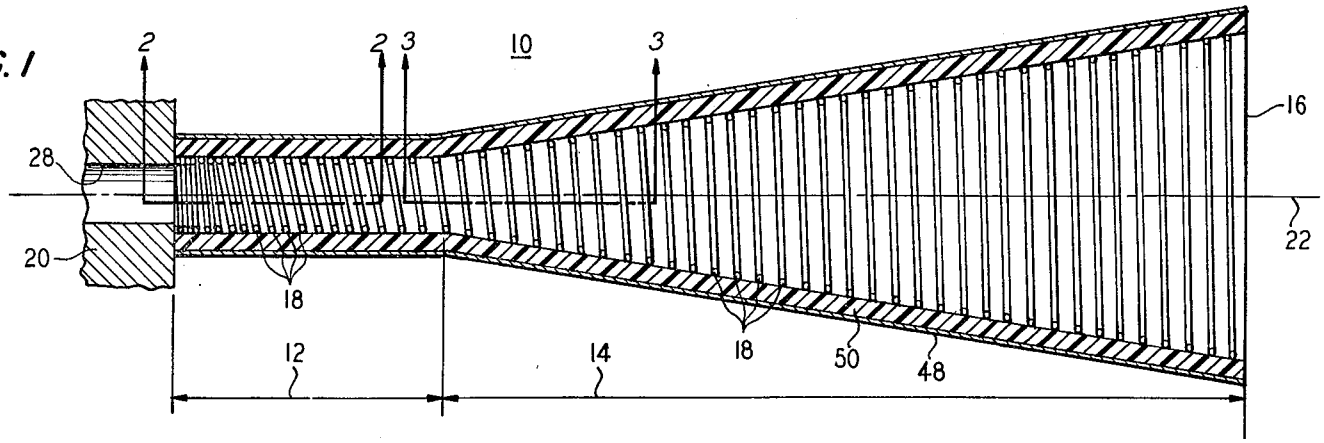
FIG. 1 illustrates a helical hybrid mode feedhorn antenna in accordance with one embodiment of the present invention.

FIG. 1 illustrates a helical hybrid-mode feedhorn antenna 10 formed in accordance with one arrangement of the present invention comprising a circular waveguide mode transducer section 12 of uniform diameter which converts to a conical waveguide horn section 14 which is flared outward to form the mouth 16 of feedhorn antenna 10. A spiro-helical projection 18 is formed from a helically wound dielectrically coated wire, which is shown in greater detail in FIGS. 2 and 3, which is bonded to the dielectric coated inner surface of sections 12 and 14. Feedhorn antenna 10 is shown coupled to a circular waveguide section 20, which is of a size that is capable of propagating the $TE_{11}$ mode in the frequency band of interest, in a manner that the longitudinal axis 22 of waveguide section 20 and feedhorn antenna 10 correspond.

In accordance with the present invention, a suitable transition from the $TE_{11}$ mode to the $HE_{11}$ mode is obtained in one embodiment by starting with a round dielectrically coated wire which is partially flattened in a rolling mill and then edge-wound in closely spaced helical turns in the area adjacent to circular waveguide 20 which is at the $TE_{11}$ mode end of circular waveguide section 12. Flattening of this wire to produce the helical turns substantially increases the capacitance between adjacent turns and, therefore, substantially reduces the leakage per wavelength of the propagating signal.

Figure 2:
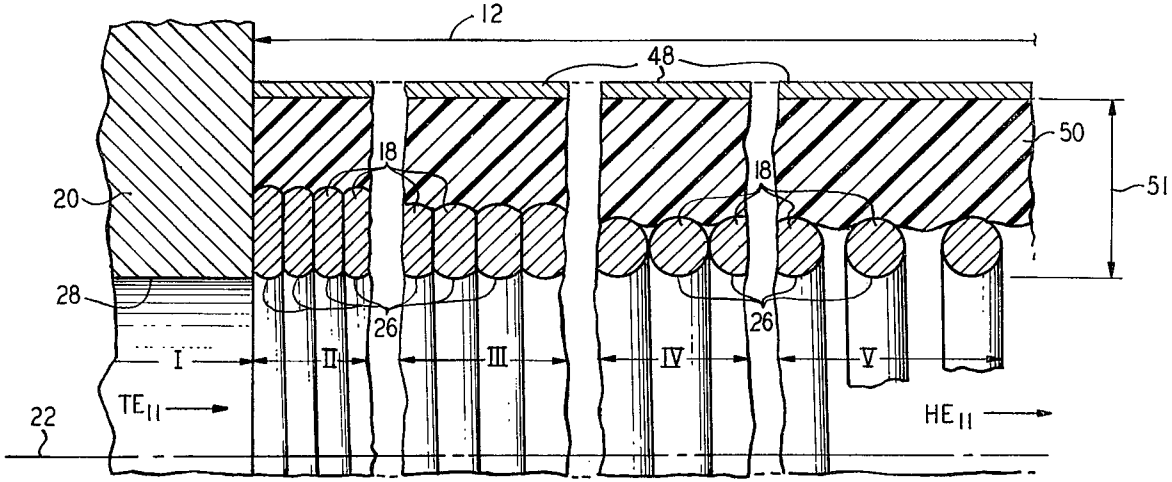
FIG. 2 illustrates an exploded view in cross-section of a portion of the circular waveguide section of the feedhorn antenna of FIG. 1 or waveguide of FIG. 5, respectively, showing one arrangement of the spiro-helical projection in accordance with the present invention.

As shown in FIG. 2, the flattening of the wire, as depicted in portions II to IV of FIG. 2, is gradually reduced starting at the input $TE_{11}$ mode end adjacent waveguide 20 to a round cross-section of closely spaced turns. For example, if a No. 15 gauge Formex copper wire 18 is used to form the helical turns of portions II to IV of FIG. 2, the wire may initially be flattened to dimensions of, for example, approximately 0.74 by 1.96 millimeters which changes gradually to a round cross-section of approximately 1.55 millimeters. The overall length of portions II to IV in FIG. 2 is an arbitrary value and is merely of sufficient length to provide a smooth transition area for continuity of the $TE_{11}$ modes between waveguide 20 and portion II, and mode conversion to the $HE_{11}$ mode in portions III to V. The edges 26 of the helical turns 18 should also be an extension of the inner wall 28 of circular waveguide 20 to avoid reflective surfaces for the propagating signal.

Figure 3:
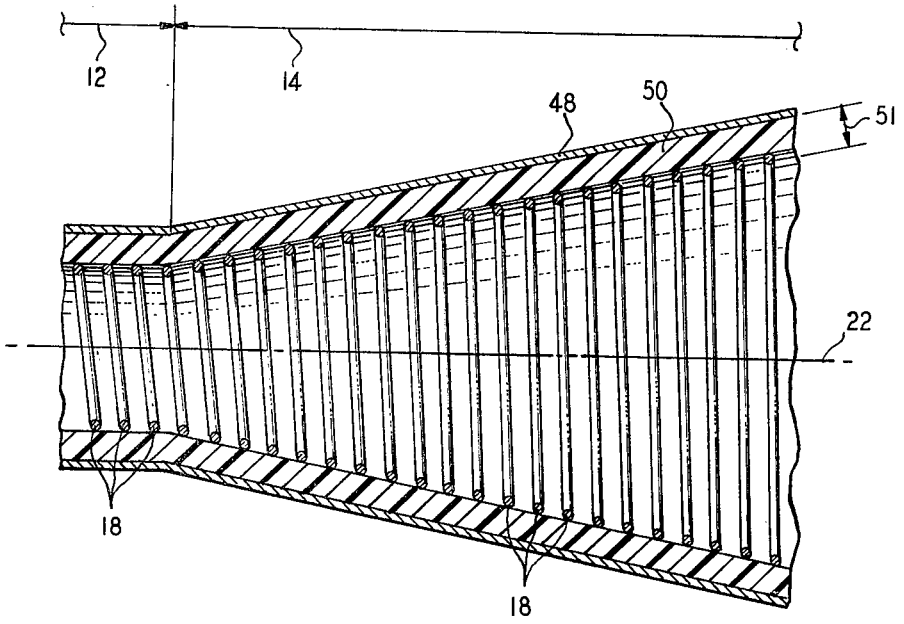
FIG. 3 illustrates an exploded view in cross-section of a portion of the feedhorn antenna of FIG. 1 where the circular section converts into the conical section.

The next portion of section 12 shown by portions IV and V of FIG. 2 includes a helical winding with a tapered pitch which starts with a zero spacing and gradually has the spacings between turns increased in a linear manner. The remainder of the helical turns in section 12 and in section 14 are of uniform pitch of, for example, approximately 3 wire diameters center-to-center as shown in FIG. 3. Therefore, in portions II to V of FIG. 2, the continuity of the $TE_{11}$ mode is preserved in a smooth transition between waveguide 20 and horn antenna 10 and the $TE_{11}$ mode is converted to the $HE_{11}$ mode by the gradually increased spacing between the helical turns while the conical section 14 provides a proper impedance match with its uniform tapered helical turns for launching the converted mode from the mouth 16 of feedhorn antenna 10 into space.

Figure 4:
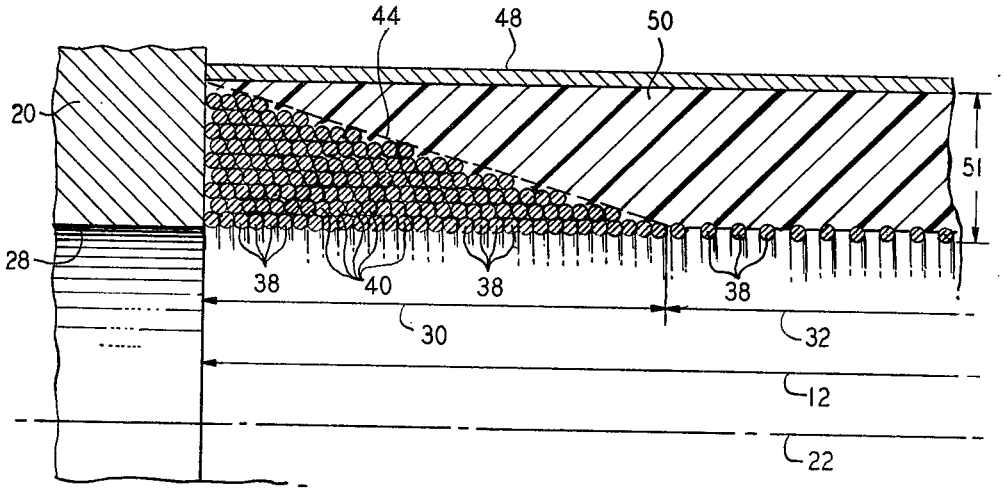
FIG. 4 illustrates an exploded view in cross-section of a portion of the circular waveguide section of the feedhorn antenna of FIG. 1 or waveguide of FIG. 5, respectively, showing an alternative arrangement of the spiro-helical projection of FIG. 2 in accordance with the present invention.

An alternative and preferred method for forming the feedhorn antenna 10 in accordance with the present invention is shown in FIG. 4. There a multi-layer helical wire structure is formed in the area 30 which is equivalent to portions II and IV of FIG. 2. In forming the helical projection of FIG. 4, a round dielectrically coated wire is first formed in a helix of closely spaced turns for the length of area 30 and then in area 32 the spacings between the helical turns are gradually increased in a linear manner. Wire 38 continues its helical spiral for the remainder of section 12 and in section 14, in the manner shown in FIG. 3, with a uniform pitch. Once wire 38 has been formed as described for traversing the entire length of the inside surface of feedhorn 10, a second layer of helical turns of dielectrically coated wire 40 is superimposed on top of the helical turns of wire 38 starting at waveguide 20 and extending for most of the length of transition area 30. Additional layers of helical turns of dielectrically coated wire are then superimposed on top of wires 38 and 40 with each layer extending for a lesser distance along area 30 so as to effectively form a taper 44 along the ends of the layers. In accordance with the present invention, the number of layers of wire in transition area 30 is arbitrary and should be of a sufficient number to provide a low enough surface impedance for propagating the $TE_{11}$ mode. In forming the arrangement of FIG. 4 it was found that preferably at least four layers should be used and that each additional layer of wire improved the performance substantially by providing less leakage per wavelength.

Construction of the helical arrangements of FIGS. 1–4 can be accomplished by winding the wire 18 or 38 on a suitable mandrel and securing both ends. Additional layers of wire can be wound on the initial turns for forming the structure of FIG. 4. When the helical structure is completely formed, a uniform thickness homogenious layer of dielectric material 50 is bonded to the wire 18 or 38 and then enclosed in a conductive sheath 48. The combined thickness 51 of dielectric layer 50 and helix wire 18 capacitive loading should be approximately an electrical quarter wavelength at the lowest operating frequency. The outer shield wall 48 can comprise any suitable conductive material. The final feedhorn 10 structure can then be coupled to waveguide 20 by any suitable means as, for example, a flange (not shown).

Figure 5:
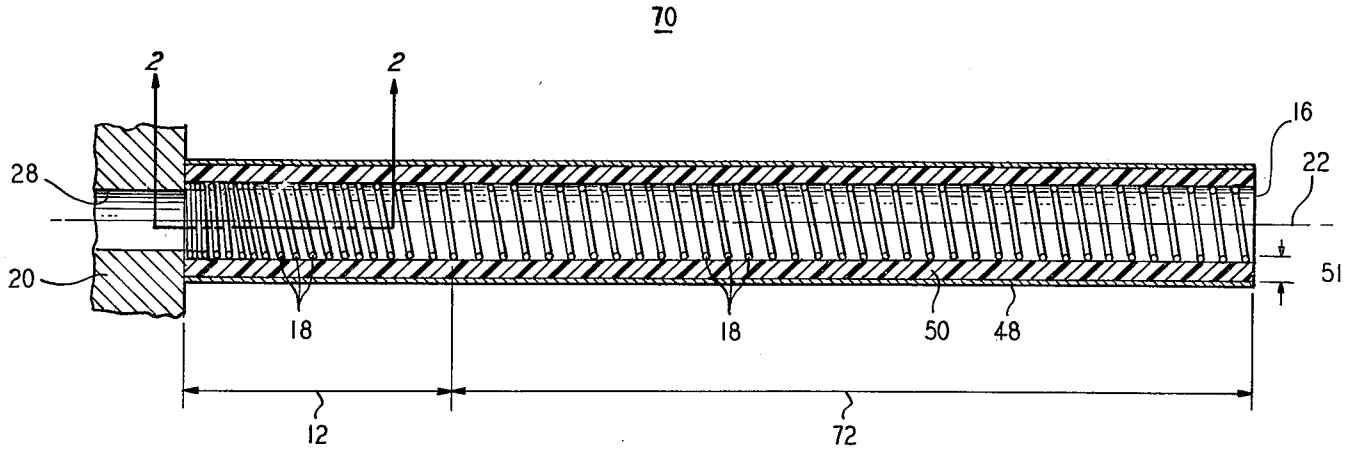
FIG. 5 illustrates a helical hybrid mode waveguide in accordance with the present invention.

FIG. 5 illustrates a circular hybrid mode waveguide 70 formed in the same manner as that shown in FIGS. 1–4 and described hereinbefore for feedhorn antenna 10 except that circular waveguide section 10 continues with the same uniform diameter in section 72 as found in section 12 instead of converting to a conical section 14 as found in feedhorn antenna 10.

It is to be understood that the above-described embodiments are simply illustrative of the principles of the invention. Various other modifications and changes may be made by those skilled in the art which will embody the principles of the invention and fall within the spirit and scope thereof as, for example, substituting a rectangular or square waveguide body for circular waveguide body 48 of FIGS. 1–5.

I claim:

1. A hybrid mode feedhorn antenna comprising:

a hollow waveguide body including an inner surface and comprises a first section (12) of uniform cross-section which converts into a second section (14) that flares outward from one end of the first section to form a mouth of the feedhorn antenna characterized in that the feedhorn antenna further comprises:

a spiro-helical projection (18, FIGS. 1–3; 38, FIG. 4) comprising a helically wound dielectrically coated wire bonded to the waveguide body with a dielectric layer, said wire being helically wound in closely spaced turns which abut one another starting at the end of the first section further from the second section and covering a first portion (II-IV, FIG. 2; 30, FIG. 4) of the inner surface of the first section in a manner capable of providing a smooth transition for a $TE_{11}$ mode signal propagating therethrough, the helical windings continuing in a second portion (V, FIG. 2; 32, FIG. 4) of the first section adjacent said first portion with turns which gradually have the spacing therebetween increased in a linear manner which is capable of converting the $TE_{11}$ mode of a signal propagating therethrough into a $HE_{11}$ mode, and the helical windings continuing in the remaining portion of the feedhorn antenna with a uniform pitch.

2. A hybrid mode feedhorn antenna according to claim 1 characterized in that the spiro-helical projection (18) in said first portion (II-IV, FIG. 2) of the first section is formed from a dielectrically coated wire which is initially flattened on two opposing surfaces and edge wound in abutting helical turns, the wire gradually changing to a rounded cross-section as the helix approaches said second portion of the first section.

3. A hybrid mode feedhorn antenna according to claim 1 characterized in that the spiro-helical projection (18) in said first portion (30, FIG. 4) further includes multiple abutting layers of helically wound dielectrically coated wires (40, FIG. 4) disposed on the surface of said first helically wound wire nearest the inner surface of the first section of the waveguide body, the successive layers of helically wound dielectrically coated wires forming said multiple layers having lengths, which progress inwards from the end of the first section furthest from the conical section, to effect an edge on said multiple layers which slopes inward to said first helically wound wire in the direction of said second portion of the first section.

4. A hybrid mode feedhorn antenna according to claim 1, 2 or 3 characterized in that the thickness of the wire and the dielectric layer being an approximate quarter wavelength at the lowest operating frequency of the feedhorn antenna.

5. A hybrid mode waveguide comprising:

a hollow waveguide body including an inner surface characterized in that the hybrid mode waveguide further comprises:

a helical projection (18, FIG. 5) comprising a helically wound dielectrically coated wire bonded to the waveguide body with a dielectric layer, said wire being helically wound in closely spaced turn which abut one another starting at one end of the waveguide body and covering a first portion of the inner surface of the waveguide body in a manner capable of providing a smooth transition for a $TE_{11}$ mode signal propagating therethrough, the helical windings continuing in a second portion of the waveguide body adjacent said first portion with turns which gradually have the spacing therebetween increased in a linear manner which is capable of converting the $TE_{11}$ mode of a signal propagating therethrough into a $HE_{11}$ mode, and the helical windings continuing in the remaining portion of the waveguide body with a uniform pitch.

6. A hybrid mode waveguide according to claim 5 characterized in that the helical projection (18) in said first portion of the waveguide body is formed from a dielectrically coated wire which is initially flattened on two opposing surfaces and edge wound in abutting helical turns, the wire gradually changing to a rounded cross-section as the helix approaches said second portion of the waveguide body.

7. A hybrid mode waveguide according to claim 5 characterized in that the helical projection (18) in said first portion of the waveguide body further includes multiple abutting layers of helically wound dielectrically coated wires disposed on the surface of said first helically wound wire nearest the inner surface of the waveguide body, the successive layers of helically wound wires forming said multiple layers having lengths, which progress inwards from said one end of the waveguide, to effect an edge on said multiple layers which slopes inward to said first helically wound wire in the direction of said second portion of the waveguide body.

8. A hybrid mode waveguide according to claim 5, 6 or 7 characterized in that the thickness of the wire and the dielectric layer being an approximate quarter wavelength at the lowest operating frequency of the waveguide.

9. A waveguide for converting a $TE_{11}$ mode signal into a $HE_{11}$ mode signal comprising:

a hollow waveguide section comprising an inner surface characterized in that the waveguide further comprises:

a mode conversion means (III–V, FIG. 2; 72, FIG. 5) comprising a helically wound dielectrically coated wire bonded to the inner surface of the waveguide section with a dielectric layer, said wire being wound in closely spaced turns which abut one another starting at one end of the waveguide section and covering a first portion of the inner surface of the waveguide section in a manner capable of providing a smooth transition for the $TE_{11}$ mode signal propagating therethrough, the helical windings continuing in a second portion of the waveguide section adjacent said first portion with turns which gradually have the spacing therebetween increased in a linear manner to convert the $TE_{11}$ mode signal to the $HE_{11}$ mode signal.

10. A waveguide according to claim 9 characterized in that the helical projection (18) in said first portion of the waveguide section is formed from a dielectrically coated wire which is initially flattened on two opposing surfaces and edge wound in abutting helical turns, the wire gradually changing to a rounded cross-section as the helix approaches said second portion of the waveguide section.

11. A waveguide according to claim 9 characterized in that the helical projection (18) in said first portion of the waveguide section further includes multiple abutting layers of helically wound dielectrically coated wires disposed on the surface of said first helically wound wire nearest the inner surface of the waveguide section, the successive layers of helically wound wires forming said multiple layers having lengths, which progress inwards from said one end of the waveguide section, to effect an edge on said multiple layers which slopes inward to said first helically wound wire in the direction of said second portion of the waveguide section.

12. A waveguide in accordance with claim 9, 10 or 11 characterized in that the thickness of the wire and the dielectric layer being an approximate quarter wavelength at the lowest operating frequency of the waveguide.

* * * * *